US012680798B2

(12) United States Patent
Keene

(10) Patent No.: US 12,680,798 B2
(45) Date of Patent: Jul. 14, 2026

(54) SUPPLEMENTAL MAGAZINE HOLDER FOR A FIREARM

(71) Applicant: Harry Keene, Arcadia, FL (US)

(72) Inventor: Harry Keene, Arcadia, FL (US)

( * ) Notice: Subject to any disclaimer, the term of this patent is extended or adjusted under 35 U.S.C. 154(b) by 0 days.

(21) Appl. No.: 19/040,467

(22) Filed: Jan. 29, 2025

(65) Prior Publication Data

US 2025/0244113 A1 Jul. 31, 2025

Related U.S. Application Data

(60) Provisional application No. 63/626,605, filed on Jan. 30, 2024.

(51) Int. Cl.
*F42B 39/02* (2006.01)

(52) U.S. Cl.
CPC ..... *F42B 39/02* (2013.01)

(58) Field of Classification Search
CPC ..... F41C 27/00; F41C 23/16; F41A 35/00; F41A 17/38; F41A 9/61; F41A 9/65; F41A 9/68; F42B 39/02
See application file for complete search history.

(56) References Cited

U.S. PATENT DOCUMENTS 4,115,943 A * 9/1978 Musgrave ..... F42B 39/02 42/71.01
5,628,555 A * 5/1997 Sharrah ..... F41G 1/34 362/114
5,816,683 A * 10/1998 Christiansen ..... F41C 27/00 362/110
6,561,073 B1 * 5/2003 Høgmoe ..... F41C 33/008 89/1.4
10,323,893 B2 * 6/2019 Ramos ..... F41A 9/63
10,859,333 B2 * 12/2020 Overbeck ..... F41A 9/65
10,876,813 B2 * 12/2020 Olheiser ..... F41G 11/001
11,506,461 B1 * 11/2022 Strom ..... F41A 9/68
11,549,780 B1 * 1/2023 Henderson ..... F41C 23/12
11,698,235 B2 * 7/2023 Griffith ..... F41A 3/66 42/6
2003/0037474 A1 * 2/2003 Weber ..... F41C 23/12 42/71.02
2006/0064913 A1 * 3/2006 Gablowski ..... F41C 23/16 42/72
2010/0263255 A1 * 10/2010 Harris ..... F41C 27/00 42/90
2011/0131859 A1 * 6/2011 Lawson ..... F41G 11/003 42/90
2012/0297970 A1 * 11/2012 Langevin ..... F41A 3/66 42/14

(Continued)

*Primary Examiner* — Joshua E Freeman
(74) *Attorney, Agent, or Firm* — DP IP GROUP; Franco S. De Liguori

(57) ABSTRACT

A supplemental magazine holder for a firearm. The holder is configured in the form of a body with a one-piece construction and made of a single piece of material. The body has a longitudinal channel defined by a base and walls extending from the base, a first closed end, and a second open end opposite the closed end. The channel includes opposite first and second inner walls each including a longitudinal groove formed therein. The channel, inner walls and grooves are configured to closely receive and removably hold therein a supplemental firearm magazine.

20 Claims, 9 Drawing Sheets

(56) References Cited

U.S. PATENT DOCUMENTS

| | | | | |
|---|---|---|---|---|
| 2015/0308790 | A1* | 10/2015 | Gravelle | F41C 27/00<br>42/90 |
| 2018/0195820 | A1* | 7/2018 | Noonan | F41C 23/16 |
| 2018/0202745 | A1* | 7/2018 | Poindextex | F41A 23/02 |
| 2018/0216904 | A1* | 8/2018 | Noonan | F41A 9/68 |
| 2018/0224239 | A1* | 8/2018 | Noonan | F41C 23/22 |
| 2019/0249969 | A1* | 8/2019 | Griffith | F41A 17/38 |
| 2024/0142195 | A1* | 5/2024 | Henderson | F41C 23/16 |

* cited by examiner

SUPPLEMENTAL MAGAZINE HOLDER FOR A FIREARM

RELATED APPLICATION

This application claims the benefit of U.S. Provisional Patent Application No. 63/626,605, filed Jan. 30, 2024.

TECHNICAL FIELD

The present invention relates generally to the field of firearms, and particularly to a supplemental magazine holder for temporarily and removably securing an additional or supplemental ammunition magazine to the firearm and which will expedite the exchange of the supplemental ammunition magazine on the firearm.

BACKGROUND INFORMATION

Handheld firearms are conventionally equipped with a magazine or clip capable of holding anywhere from perhaps a half dozen to on the order of thirty or so rounds of ammunition. Oftentimes this may not be sufficient for the operation at hand, and the shooter must remove the depleted magazine and install a full magazine in the weapon. The existing challenges in rapidly exchanging ammunition magazines, particularly in high-stakes situations such as combat or law enforcement, highlight the importance of a swift and efficient solution.

The current state of the art involves various devices and aids, including those designed for attaching accessories like aiming devices or lights to firearms. These devices are not configured nor suitable for securing ammunition magazines to the firearm for quick and easy access.

In the quest for an improved solution, various devices have been proposed as supplemental magazine holders for weapons. However, in addition to having a complex construction and being expensive to manufacture, none of these existing devices seem to precisely address the foregoing challenges relating to the rapid exchanging of ammunition magazines.

Consequently, there is a need for an enhanced and innovative supplemental magazine holder for firearms which overcomes the foregoing and other drawbacks in the conventional art.

SUMMARY

A principal object of the present invention is to provide a supplemental magazine holder which will expedite the exchange of detachable magazines on firearms. In essence, the call for an enhanced supplemental magazine holder centers around addressing the critical need for rapid magazine replacement in high-pressure situations. The supplemental magazine holder of the present invention surpasses the limitations of existing solutions, providing a versatile and efficient mechanism for securely holding supplemental ammunition magazines while ensuring swift and reliable access.

In one aspect, the present invention provides a supplemental magazine holder for a firearm. In one embodiment, the holder is configured in the form of a body with a one-piece construction and made of a single piece of material. The body has a longitudinal channel defined by a base and walls extending from the base, a first closed end, and a second open end opposite the closed end. The channel includes opposite first and second inner walls each including a longitudinal groove formed therein. The channel, inner walls and grooves are configured to closely receive and removably hold therein a supplemental firearm magazine.

According to a feature of the present invention, the closed end of the body is configured to limit movement of the supplemental magazine in the longitudinal direction of the body when the magazine is inserted into and received by the channel.

As another feature of the present invention, the holder includes mounting means for removably mounting the holder to the firearm. In an exemplary embodiment, the mounting means comprises fastening elements, such as hardware.

As yet another feature of the present invention, the body is made of a hard and dense but resilient plastic material configured to frictionally engages the supplemental magazine to remain in place without the need for additional fastening means, but which permits the magazine to be readily removed via the second open end by sliding the magazine along the channel. The material selected for the body is preferably durable while exhibiting sufficient flexibility to allow the magazine to be gripped resiliently therein for ease of insertion and removal thereof. In exemplary embodiments, the material used is Acrylonitrile Styrene Acrylate (ASA) or Acrylonitrile Butadiene Styrene (ABS).

In still another feature of the present invention, the holder is configured to function as a support grip during use of the firearm.

In another aspect, the present invention is directed to the combination of a firearm and at least one supplemental magazine holder according to foregoing embodiment of the present invention. In one exemplary embodiment, the at least one supplemental magazine holder comprises a plurality of supplemental magazine holders.

In exemplary embodiments, the firearm may be a rifle, a pistol or a handgun. In a particular embodiment, the firearm is an AR-15-style rifle or pistol. In yet another embodiment, supplemental magazine comprises a Glock®-type magazine.

These and other features and advantages of the present invention will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

The present disclosure now will be described more fully hereinafter with reference to the accompanying drawings, in which exemplary embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art.

For convenience of description, the terms "front", "back", "upper", "lower", "top", "bottom", "front", "rear", "right", "left", "side" and words of similar import will have reference to the various members and components of the shapewear garment of the present disclosure as arranged and illustrated in the figures of the drawings and described hereinafter in detail.

Embodiments of the present invention provide supplemental magazine holders for a firearm (e.g., generally denoted at 50, 150 and 200 in FIGS. 8, 9, 17-18, and 19-20, respectively) for temporarily and removably securing one or more additional or supplemental ammunition magazine to the firearm. The supplemental magazine holder is configured to be removably attached to the firearm and to hold a supplemental or spare magazine therein for rapid access by the shooter as required.

The word "firearm" is used herein in a broad sense and should not be construed as limited to any particular class. The illustrations are exemplary and have been chosen only for. purposes of disclosure. The embodiments shown should not be considered limiting, as the principle of the invention can be applied to various classes of firearms. Furthermore, this invention can be employed with replicas of firearms, or with dummy training firearms such as are sometimes used in military forces. Expressed differently, it is not intended to limit the utility of this invention to firearms capable of firing live ammunition. It can also be used with dummy, replica, or non-shooting "firearms".

FIGS. 1 through 9 illustrate a first embodiment of the magazine holder ("hereinafter also "holder"), generally designated at 10, according to the present invention.

Figure 1:
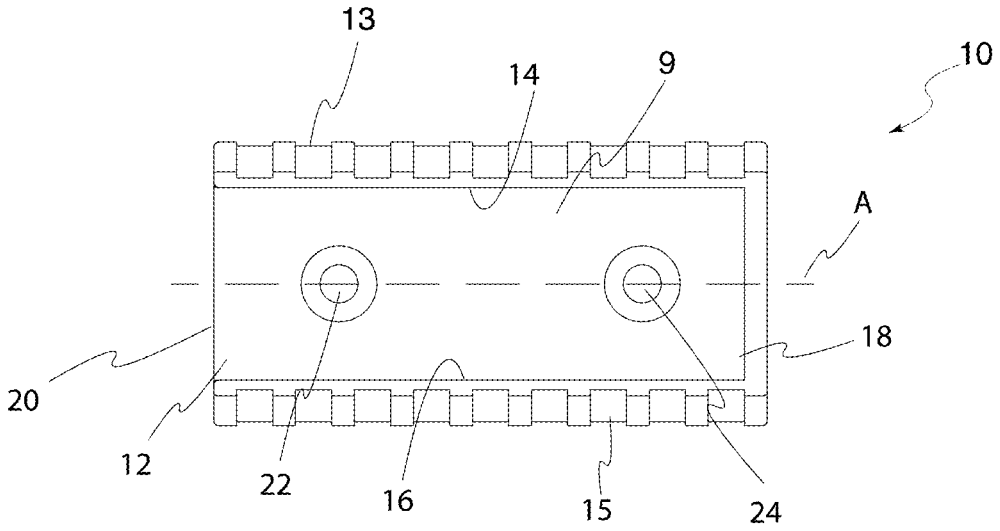
FIG. 1 is a front view of a supplemental magazine holder for a firearm according to a first embodiment of the present invention.
Figure 2:
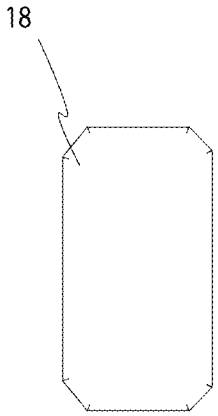
FIG. 2 is a first end view of the supplemental magazine holder shown in FIG. 1.
Figure 3:
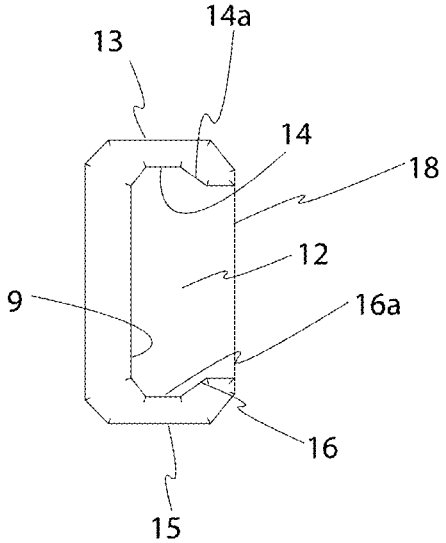
FIG. 3 is a second end view of the supplemental magazine holder shown in FIG. 1.
Figure 4:
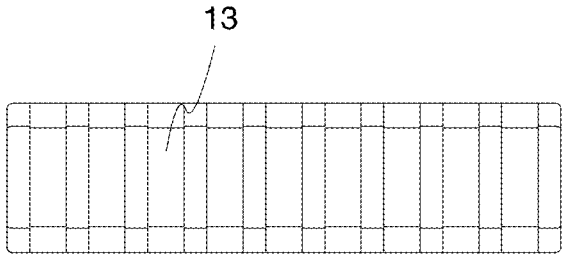
FIG. 4 is a top view of the supplemental magazine holder shown in FIG. 1.
Figure 5:
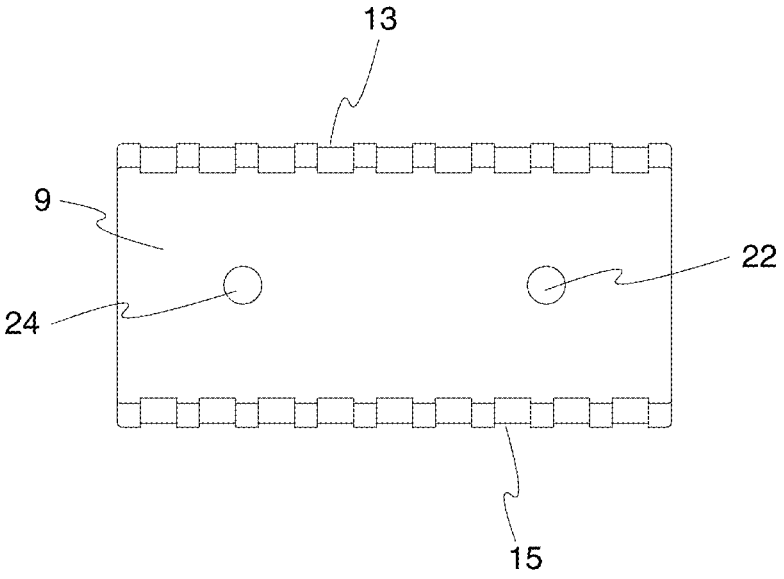
FIG. 5 is a rear view of the supplemental magazine holder shown in FIG. 1.
Figure 6:
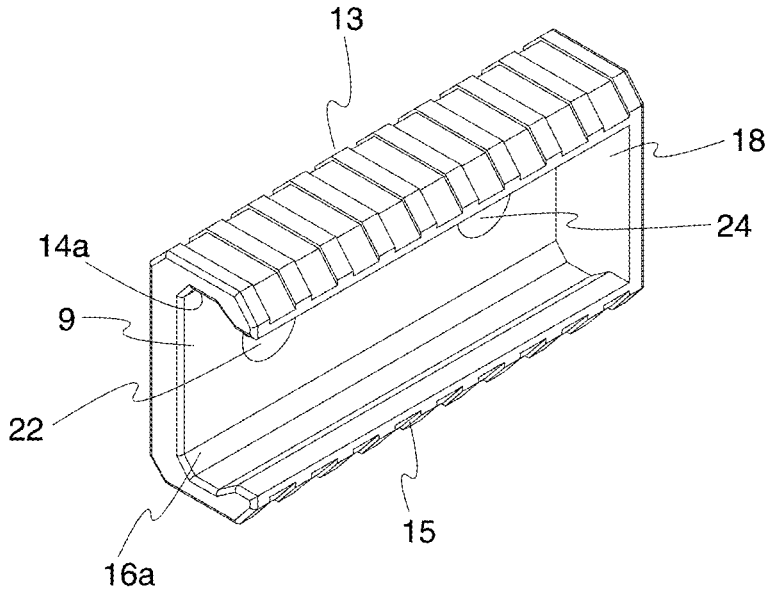
FIG. 6 is a perspective view of the supplemental magazine holder shown in FIG. 1.
Figure 7:
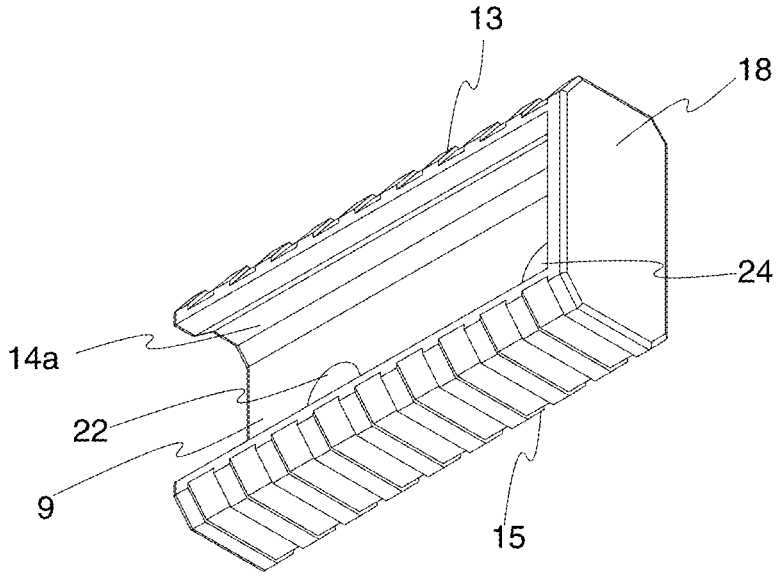
FIG. 7 is another perspective view of the supplemental magazine holder shown in FIG. 1.

Holder 10 is a body having a one-piece construction and preferably formed of a high-density plastic material to provide suitable combinations of resilience and durability. For example, Acrylonitrile Styrene Acrylate (ASA) and Acrylonitrile Butadiene Styrene (ABS) are suitable materials for forming the body. Holder 10 is longitudinally symmetrical about line A shown in FIG. 1, which facilitates installation and removal of holder 10 relative to the firearm as well as handling of the supplemental magazine held by holder 10. As best shown in FIG. 3, holder 10 has a generally C-shaped cross-section throughout, except at and end portion of holder 10 corresponding to closed end 18 described below.

Figure 8:
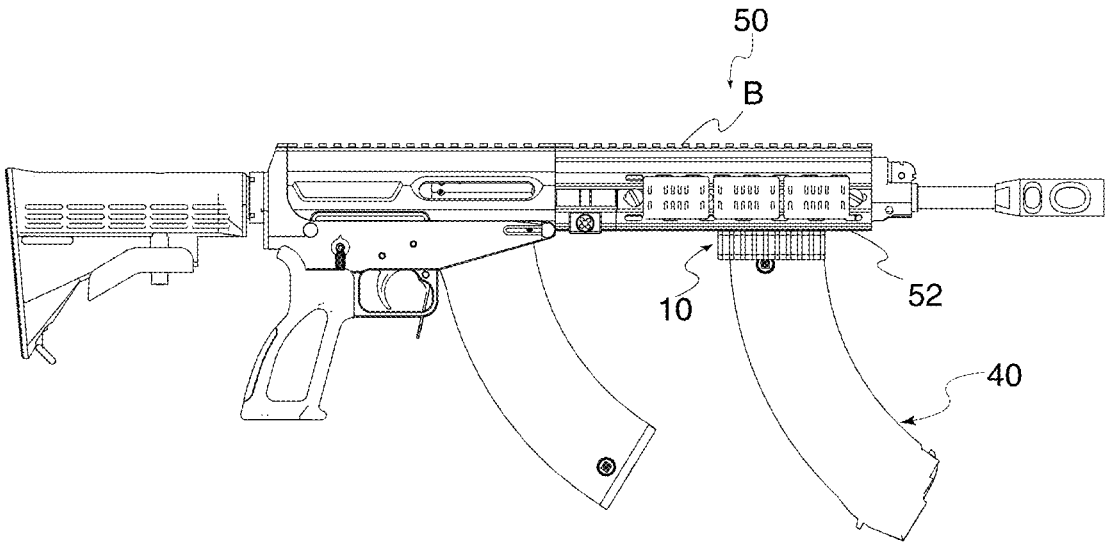
FIG. 8 is a side view of a firearm incorporating the supplemental magazine holder according to the first embodiment of the present invention.
Figure 9:
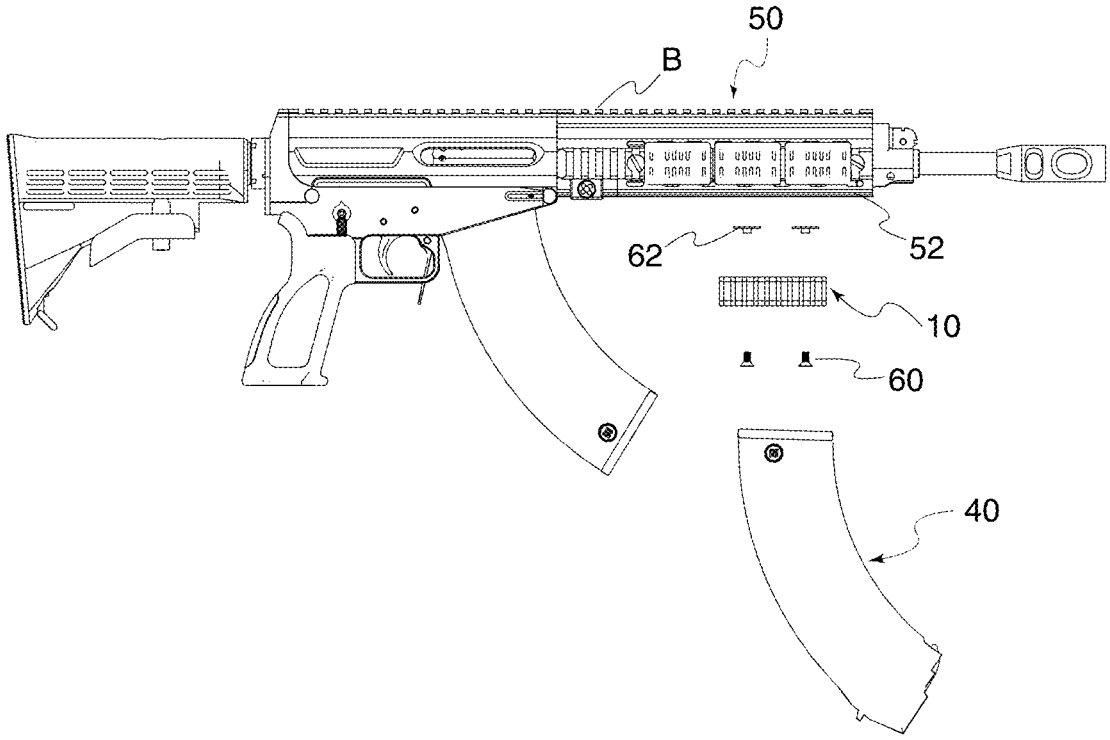
FIG. 9 is a view similar to FIG. 8 illustrating, in partial exploded view, the supplemental magazine holder, means for removably mounting the holder to the firearm, and an exemplary supplemental magazine configured to be removably retained by the holder.

Holder 10 includes a longitudinal channel 12 defined by a base 9 and walls 13, 15 extending from base 9, a first closed end 18, and a second open end 20 opposite end 18. Channel 12 includes opposite first and second inner walls 14, 16. Each of inner walls 14, 16 includes a longitudinal groove, respectively **14*a*, 16*a*, formed therein. Channel 12, inner walls 14, 16 and grooves 14*a*, 16*a* are configured to closely receive and removably hold therein a conventional firearm magazine 40 as shown in FIGS. 8, 9. Closed end 18 of holder 10 defines a means for limiting movement of the magazine in the longitudinal direction of holder 10 when the magazine is inserted into and received by channel 12. The material for holder 10 is preferably relatively hard and dense but resilient plastic material that frictionally engages the magazine to remain in place without the need for additional fastening means, but which permits the magazine to be readily removed, via open end 20, as desired by sliding the magazine along channel 12. By this construction, holder 10 is provided with the desired durability while exhibiting sufficient flexibility to allow magazine 40** to be gripped resiliently therein for ease of insertion and removal thereof.

Referring to FIGS. 1, 5, 8 and 9, base 9 of holder 10 is provided with through openings 22, 24 for removably mounting holder 10 to a structural part 52 (e.g., a rail portion) of firearm 50. This is accomplished by means of fastener elements including, for example, threaded elements 60 configured to be passed through respective openings 22, 24 for engagement with respective washer elements 62 which are in turn configured for removable engagement with structural part 52 of firearm 50. For example, washer elements 62 are configured for adjustment along a rail portion of firearm 50 to allow proper positioning of holder 10 relative to firearm 50 and permit removable, but secure, connection of holder 10 to firearm 50 upon connection to threaded elements 60.

Holder 10 may be readily installed and used with any practicable type or configuration of firearm 50 having a barrel B and/or other forwardly disposed structure 52 adjacent the barrel B as described above. For example, FIGS. 8, 9 illustrate an AR-15-style rifle equipped with holder 10. For this purpose, channel 12, including inner walls 14, 16 and grooves **14*a*, 16*a*, of holder 10 is specifically configured to receive, accommodate, and removably hold a standard magazine 40** for an AR-15-style rifle or pistol.

FIGS. 10-18 illustrate a second embodiment of the magazine holder ("hereinafter also "holder"), generally designated at 100, according to the present invention. Holder 100 of the second embodiment differs from holder 10 of the first embodiment described above in that holder 100 is configured for use with a standard magazine for a Glock®-type magazine rather than a magazine for an AR-15-style rifle or pistol.

Referring to FIGS. 10-16, similar to holder 10, holder 100 is a body having a one-piece construction and is preferably formed of a high-density plastic material to provide suitable combinations of resilience and durability. For example, Acrylonitrile Styrene Acrylate (ASA) and Acrylonitrile Butadiene Styrene (ABS) are suitable materials for forming the body.

Figure 10:
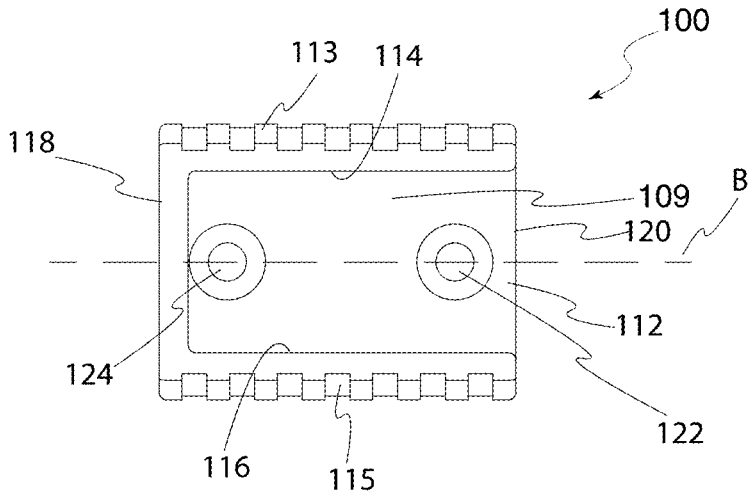
FIG. 10 is a front view of a supplemental magazine holder for a firearm according to a second embodiment of the present invention.
Figure 11:
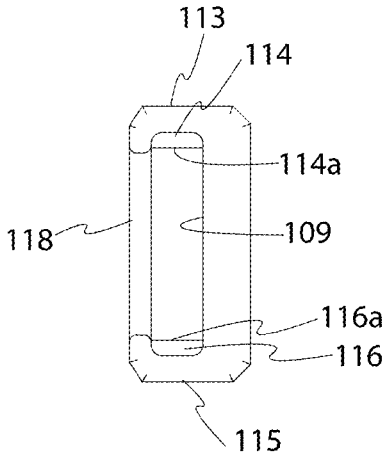
FIG. 11 is a first end view of the supplemental magazine holder shown in FIG. 10.
Figure 12:
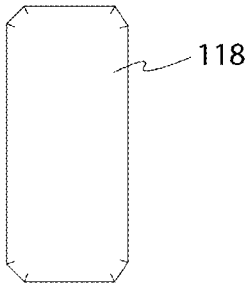
FIG. 12 is a second end view of the supplemental magazine holder shown in FIG. 10.
Figure 13:
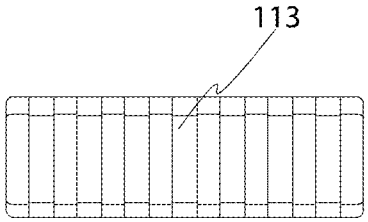
FIG. 13 is a top view of the supplemental magazine holder shown in FIG. 10.
Figure 14:
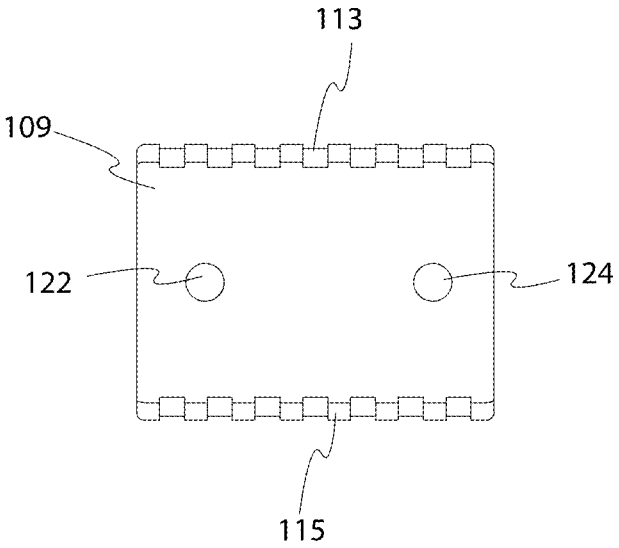
FIG. 14 is a rear view of the supplemental magazine holder shown in FIG. 10.
Figure 15:
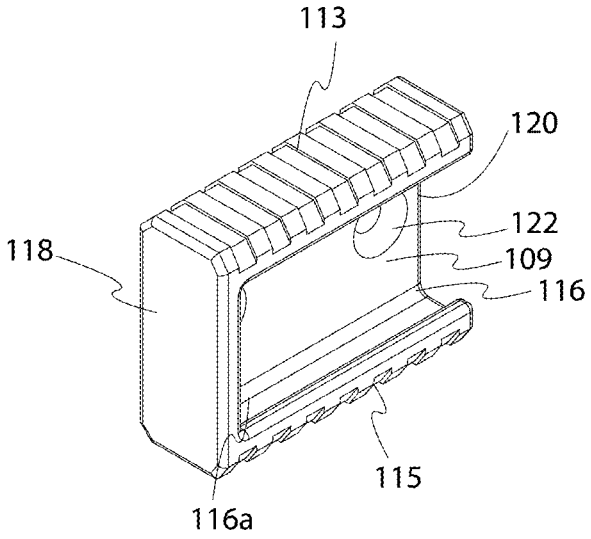
FIG. 15 is a perspective view of the supplemental magazine holder shown in FIG. 10.
Figure 16:
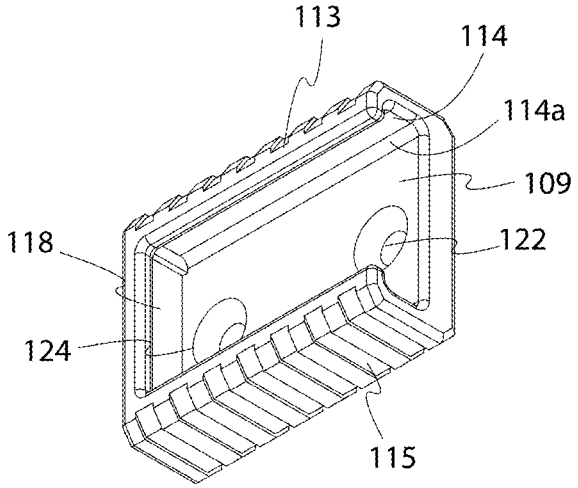
FIG. 16 is another perspective view of the supplemental magazine holder shown in FIG. 10.

Holder 100 is longitudinally symmetrical about line B shown in FIG. 10, which facilitates installation and removal of holder 100 relative to the firearm as well as handling of the supplemental magazine held by holder 100. As best shown in FIG. 11, holder 100 also has a generally C-shaped cross-section throughout, except at and end portion of holder 100 corresponding to closed end 118, similar to holder 10.

Figure 17:
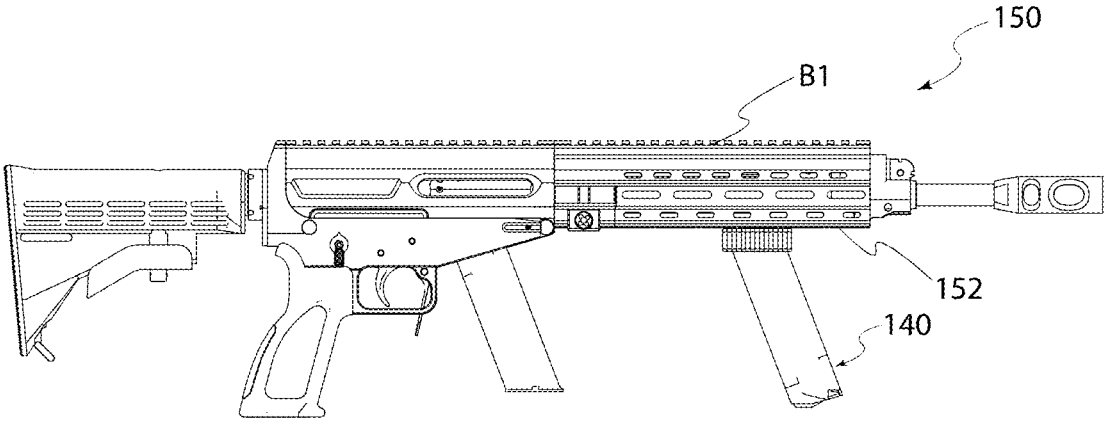
FIG. 17 is a side view of a firearm incorporating the supplemental magazine holder according to the second embodiment of the present invention.
Figure 18:
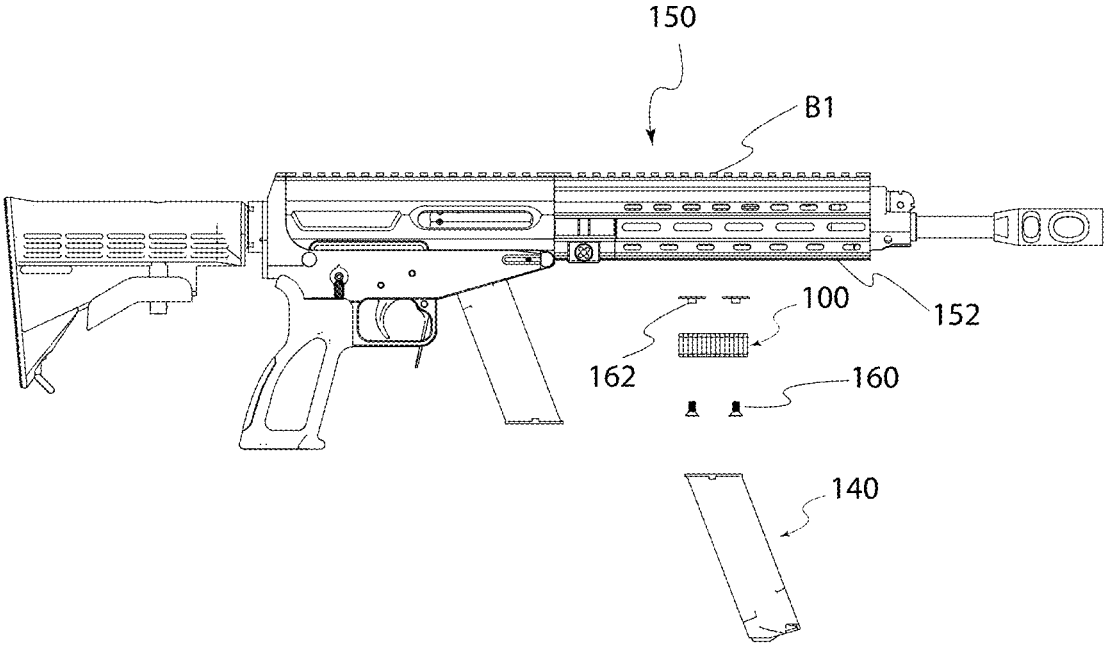
FIG. 18 is a view similar to FIG. 17 illustrating, in partial exploded view, the supplemental magazine holder, the means for removably mounting the holder to the firearm, and an exemplary supplemental magazine configured to be removably retained by the holder.

Holder 100 includes a longitudinal channel 112 defined by a base 109 and walls 113, 115 extending from base 109, the first closed end 118, and a second open end 120 opposite closed end 118. Channel 112 includes opposite first and second inner walls 114, 116. Each of inner walls 114, 116 includes a longitudinal groove, respectively 114*a*, 116*a*, formed therein. Channel 112, inner walls 114, 116 and grooves 114*a*, 16*a* are configured to closely receive and removably hold therein a conventional firearm magazine 140 as shown in FIGS. 17, 18. Closed end 118 of holder 100 defines a means for limiting movement of the magazine in the longitudinal direction of holder 100 when the magazine is inserted into and received by channel 112. The material for holder 100 is preferably relatively hard and dense but resilient plastic material that frictionally engages the magazine to remain in place without the need for additional fastening means, but which permits the magazine to be readily removed, via open end 120, as desired by sliding the magazine along channel 112. By this construction, holder 100 is provided with the desired durability while exhibiting sufficient flexibility to allow magazine 140 to be gripped resiliently therein for ease of insertion and removal thereof.

Referring to FIGS. 10, 14, 15 and 16, base 109 of holder 100 is provided with through openings 122, 124 for removably mounting holder 100 to a structural part 152 (e.g., a rail portion) of firearm 150. This is accomplished by means of fastener elements including, for example, threaded elements 160 configured to be passed through respective openings 122, 124 for engagement with respective washer elements 162 which are in turn configured for removable engagement with structural part 152 of firearm 150. For example, washer elements 162 are configured for adjustment along a rail portion of firearm 150 to allow proper positioning of holder 100 relative to firearm 150 and permit removable, but secure, connection of holder 100 to firearm 150 upon connection to threaded elements 160.

Holder 100 may be readily installed and used with any practicable type or configuration of firearm 150 having a barrel B1 and/or other forwardly disposed structure 152 adjacent to the barrel B1 as described above. For example, FIGS. 17, 18 illustrate firearm 150 equipped with holder 100 configured for a Glock®-type magazine 140. For this purpose, channel 112, including inner walls 114, 116 and grooves 114*a*, 116*a*, of holder 100 is specifically configured to receive, accommodate, and removably hold the Glock®-type magazine 140. In this regard, it is noted that the overall length of holder 100 in this embodiment is shorter than the length for holder 10 described above for the second embodiment with reference to FIGS. 1-9, and this is for the purpose of accommodating different number of firearm rounds.

Figure 19:
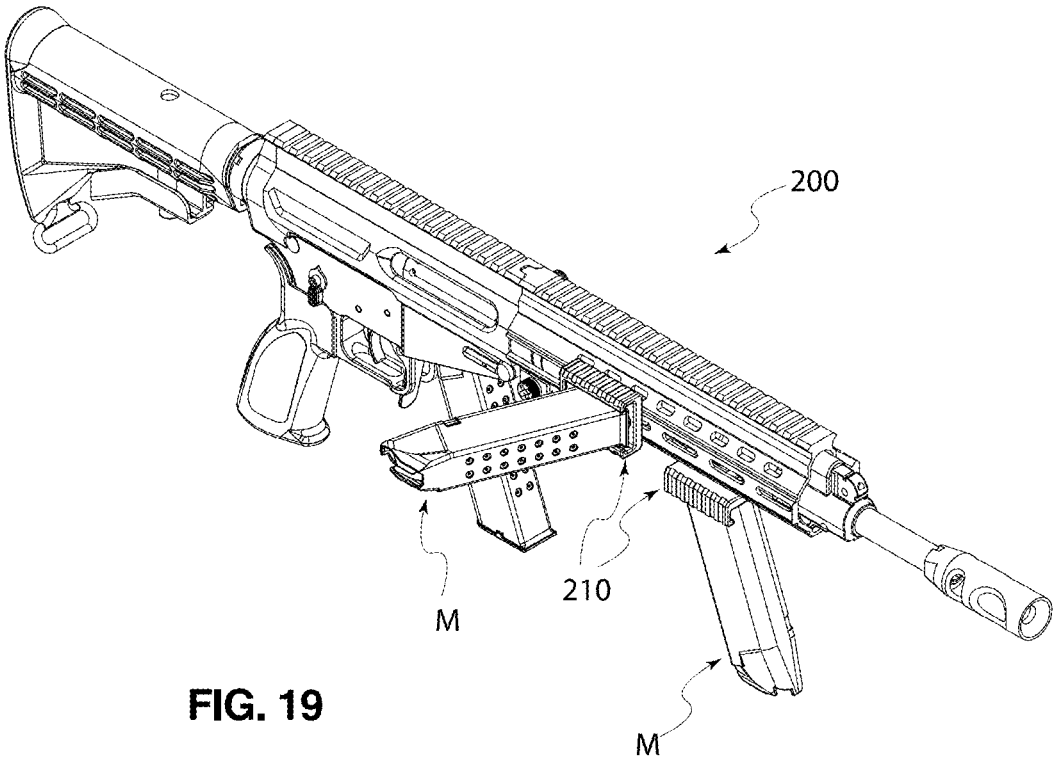
FIG. 19 is a perspective view illustrating another aspect of the present invention in which multiple supplemental magazine holders according to the first and/or second embodiments of the present invention are removably mounted to a firearm.
Figure 20:
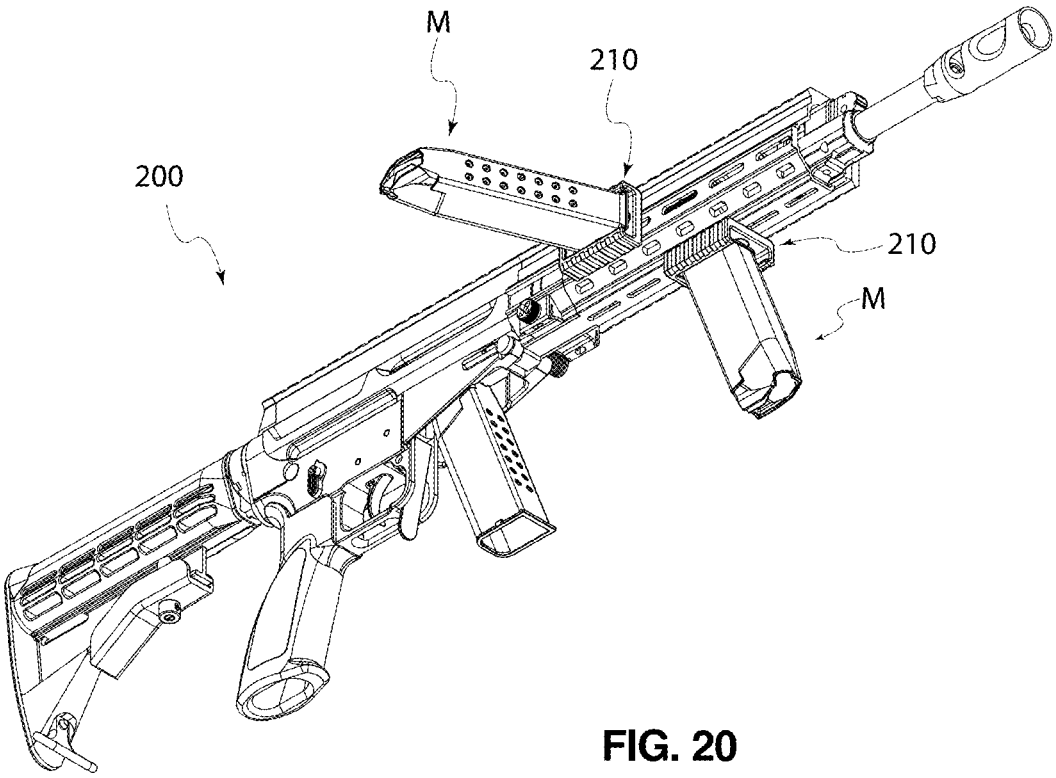
FIG. 20 is another perspective view of the aspect of the present invention shown in FIG. 19.

FIGS. 19 and 20 show another aspect of the present invention. In this aspect, multiple supplemental magazine holders, generally designated at 210, according to anyone of the first and second embodiments described above with reference to FIGS. 1-9 and 10-18, respectively, are shown mounted to a firearm 200 for removably receiving and retaining therein a supplemental magazine generally designated at M. Holders 210 can be selectively, removably mounted at various convenient positions and orientations to firearm 200, as shown in FIGS. 19 and 20, utilizing fastening elements such as described above for the first and second embodiments, for example.

In alternative embodiments, instead of being attachable to existing firearms, the supplemental magazine holders according to the embodiments and aspects of the present invention can be configured so that they are manufactured as part of new firearms.

It is understood that the supplemental magazine holders and firearm supporting frame as described herein with reference to the drawings are shown in simplified form for purpose of disclosure. In actual practice it would be necessary to adjust details and dimensions to suit various firearms and magazines.

The supplemental magazine holders according to the embodiments and aspects of the present invention are configured expedite the exchange of detachable magazine holders on firearms. The invention addresses the critical need for rapid magazine replacement in high-pressure situations. The supplemental magazine holder according to the embodiments and aspect of the present invention surpasses the limitations of existing solutions, providing a versatile and efficient mechanism for securely holding ammunition magazines while ensuring swift and reliable access.

In an exemplary operation of a firearm employing the supplemental magazine holder according to any of the embodiments and aspect of the present invention, the firearm is loaded and fired in the usual manner, but one or more extra loaded magazines are carried in the holders as already described. When the magazine in the firearm is empty, it is discarded, and a full magazine is transferred from the holder to the magazine housing in the receiver. In the firearms described herein, for example, the shooter's firing hand, while holding the grip, can unlatch and drop the empty magazine while the other hand unlatches a magazine held by the holder and transfers it to the firing position. No time is lost in orienting the fresh magazine, and firing is resumed with a minimum of delay.

Moreover, in the present invention, when holding the firearm grip with the shooting hand, the shooter can support the firearm with the other hand by gripping the supplemental magazine holder mounted to the firearm as described above. This provides the shooter with a vertical front grip to reduce recoil while shooting, thereby promoting balance during shooting. Thus, the magazine holder according to the present invention is particularly configured for use as a support grip (e.g., an auxiliary support grip) during use of the firearm.

As described above, the supplemental magazine holders according to the embodiments and aspect of the present invention are formed in one piece from a single piece of material, such as Acrylonitrile Styrene Acrylate (ASA) or Acrylonitrile Butadiene Styrene (ABS). The holder can be manufactured using various injection molding techniques or by 3D printing, for example. In alternative embodiments, the holder can be made of suitable metal materials, such as an aluminum alloy exhibiting a high strength-to-weight ratio.

By the foregoing features, the supplemental magazine holders according to the present invention are particularly suitable for mass production at an economical cost.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A supplemental magazine holder for a firearm, the holder comprising:

a body having a one-piece construction and being formed from a single piece of material, the body having a generally C-shaped cross-section and including a base and first and second walls extending from the base, the base and the walls defining a longitudinal channel extending between a first closed end and a second open end opposite the closed end, the channel including opposite first and second inner walls, and each of the first and second inner walls including a longitudinal groove extending substantially along a length of the channel, wherein the channel, inner walls and grooves are configured to closely receive and removably retain a firearm magazine inserted longitudinally through the second open end, wherein the first closed end forms a longitudinal stop configured to limit forward movement of the firearm magazine within the channel, wherein the base further includes at least two spaced-apart through-openings configured to receive threaded fasteners for removably mounting the holder to a structural portion of the firearm, and wherein the body is formed of a resilient material configured to frictionally engage opposite sides of the firearm magazine within the channel to retain the magazine without additional clamping elements while permitting sliding insertion and removal through the second open end.

2. The supplemental magazine holder of claim 1, wherein the body has the generally C-shaped cross-section along substantially the entire length of the longitudinal channel except at the first closed end.

3. The supplemental magazine holder of claim 1, wherein the body is longitudinally symmetrical about a central axis such that the holder is installable in either orientation relative to the firearm.

4. The supplemental magazine holder of claim 1, wherein the body is made of a hard and dense but resilient plastic material configured to frictionally engage the firearm magazine within the channel.

5. The supplemental magazine holder of claim 4, wherein the material of the body is durable while exhibiting sufficient flexibility to allow resilient gripping of the firearm magazine during insertion and removal thereof.

6. The supplemental magazine holder of claim 1, wherein the through-openings are configured to receive threaded fasteners cooperating with washer elements configured to engage an accessory rail portion of the firearm.

7. The supplemental magazine holder of claim 1, wherein the first and second walls are configured to resiliently deflect relative to one another to permit insertion and removal of the firearm magazine while maintaining frictional retention of the magazine within the channel.

8. The supplemental magazine holder of claim 1, wherein the longitudinal grooves are configured to guide insertion of the firearm magazine into the channel.

9. The supplemental magazine holder of claim 1, wherein the holder is configured to be removably mounted to a forward structural portion of the firearm adjacent a barrel of the firearm.

10. The supplemental magazine holder of claim 1, wherein the channel is configured to receive a magazine for an AR-15-style rifle or pistol.

11. The supplemental magazine holder of claim 1, wherein the channel is configured to receive a Glock® pistol magazine.

12. The supplemental magazine holder of claim 1, wherein the body is manufactured by injection molding as a unitary structure.

13. The supplemental magazine holder of claim 1, wherein the firearm magazine is retained solely by frictional engagement between the walls of the channel and the magazine without clamps, springs, or adjustable fasteners.

14. A supplemental magazine holder for a firearm, the holder comprising:

a unitary body having a one-piece construction and being formed from a single piece of resilient material, the body being longitudinally symmetrical about a central axis and having a generally C-shaped cross-section, the body including a base and first and second walls extending upwardly from the base, the base and the first and second walls defining a longitudinal channel extending substantially the entire length of the body between a first closed end and a second open end opposite the first closed end, the channel including opposite first and second inner walls, and each of the first and second inner walls including a longitudinal groove extending substantially along the length of the channel, wherein the channel, inner walls and grooves are configured to closely receive and removably retain a firearm magazine inserted longitudinally into the channel through the second open end, wherein the first closed end forms a longitudinal stop configured to limit movement of the firearm magazine within the channel, wherein the base includes at least two spaced-apart through openings extending through the base, the through openings being configured to receive threaded fasteners extending through the base and engaging corresponding washer elements configured to removably secure the body to a structural rail portion of the firearm, and wherein the first and second walls are resiliently deflectable relative to one another to frictionally engage opposite sides of the firearm magazine within the channel, such that the firearm magazine is retained within the channel solely by frictional engagement between the walls and the firearm magazine without clamps, springs, or adjustable fasteners while permitting sliding insertion and removal of the firearm magazine through the second open end.

15. The supplemental magazine holder of claim 14, wherein the body has a generally C-shaped cross-section extending substantially along an entire length of the longitudinal channel except at the first closed end.

16. The supplemental magazine holder of claim 14, wherein the body is longitudinally symmetrical about a central axis such that the holder is installable in either orientation relative to the firearm.

17. The supplemental magazine holder of claim 14, wherein the body is formed from a hard and dense plastic material selected from the group consisting of Acrylonitrile Styrene Acrylate (ASA) and Acrylonitrile Butadiene Styrene (ABS).

18. The supplemental magazine holder of claim 14, wherein the through openings are configured to receive threaded fasteners cooperating with washer elements configured to engage an accessory rail portion of the firearm.

19. The supplemental magazine holder of claim 14, wherein the first and second walls are configured to resiliently deflect relative to one another to permit insertion and removal of the firearm magazine while maintaining frictional retention of the firearm magazine within the channel.

20. The supplemental magazine holder of claim 14, wherein the longitudinal grooves are configured to cooperate with corresponding longitudinal features of the firearm magazine to guide insertion of the firearm magazine into the channel.

* * * * *